US005836828A

United States Patent [19]

Sinton

[11] Patent Number: 5,836,828

[45] Date of Patent: Nov. 17, 1998

[54] GOLF TRAINING SYSTEM

[75] Inventor: Steven L. Sinton, Brooklyn Park, Minn.

[73] Assignee: Precision Guesswork Company, Brooklyn Park, Minn.

[21] Appl. No.: 694,618

[22] Filed: Aug. 13, 1996

[51] Int. Cl.[6] ..... A63B 69/36; A41D 19/00

[52] U.S. Cl. ..... 473/205; 2/161.2; 473/409

[58] Field of Search ..... 473/205, 409; 273/187.2; 2/161.2, 161.3, 161.4

[56] References Cited

U.S. PATENT DOCUMENTS

| | | | |
|---|---|---|---|
| D. 320,872 | 10/1991 | McCrane . | |
| 1,885,572 | 11/1932 | Wood | 473/205 X |
| 2,465,136 | 3/1949 | Troccoli . | |
| 3,520,539 | 7/1970 | Haws . | |
| 3,532,344 | 10/1970 | Masstab . | |
| 3,848,874 | 11/1974 | Elkins, Jr. . | |
| 4,057,255 | 11/1977 | Bishop . | |
| 4,400,831 | 8/1983 | Rietz . | |
| 4,438,532 | 3/1984 | Campanella et al. . | |
| 4,488,726 | 12/1984 | Murray . | |
| 4,502,688 | 3/1985 | Papp . | |
| 4,525,877 | 7/1985 | Chong . | |
| 4,665,565 | 5/1987 | Odom . | |
| 4,776,595 | 10/1988 | Wilkins . | |
| 4,843,651 | 7/1989 | Gramza et al. . | |
| 4,958,384 | 9/1990 | McCrane . | |
| 4,962,547 | 10/1990 | Minnick . | |
| 5,184,353 | 2/1993 | Goldwitz . | |
| 5,184,827 | 2/1993 | Suttle et al. . | |
| 5,232,225 | 8/1993 | Snyder . | |
| 5,253,367 | 10/1993 | Lappley . | |
| 5,414,868 | 5/1995 | Crawford . | |
| 5,462,280 | 10/1995 | Dickerson . | |

OTHER PUBLICATIONS

The Glove and Tru Grip, Golf Magazine, P. 148 (Apr. 1996).

*Primary Examiner*—George J. Marlo

*Attorney, Agent, or Firm*—Merchant, Gould, Smith Edell, Welter & Schmidt

[57] ABSTRACT

A golf training system for aligning both hands on a golf club is provided. The system includes a golf glove for the hand of the user placed at the upper or butt end of the club. The upper hand glove includes indicia for positioning the lower hand on the golf club with respect to the upper hand; for aligning the thumb along the centerline of the club; and aligning the golf club across the palm of the upper hand.

18 Claims, 3 Drawing Sheets

GOLF TRAINING SYSTEM

BACKGROUND OF THE INVENTION

Often the beginner and the intermediate golfer has problems with their golf swing originating from their failure to adopt and constantly use a proper grip on the golf club. Hours of training with a golf professional can be wasted if the golfer cannot later duplicate the grip perfected while training with the professional. There are a number of devices which have attempted to correct problems of this type.

For example, golf training gloves that cause the user's hands to remain securely together throughout the golf swing have been reported. Several methods of preventing the user from changing their grip during the swing have been employed, including providing a loop in the glove of one's hand so that a finger of the opposite hand may fit therein. Another method utilizes a Velcro type connection between gloves so they remain secured to one another. While these gloves address shifting of the golfer's grip throughout their golf swing, these methods rely on a mechanical engagement either between the gloves or between the glove and the golf club and they do not sufficiently aid the golfer in adjusting the placement of both hands on the golf club.

There are also golf training gloves which incorporate visible indicators such as color patches on the knuckle area or color panels along the glove which attempt to aid their user in recognizing when a proper grip is attained. These gloves, however, do not provide the golfer a methodology or means to consistently ensure it each aspect of the grip (i.e., correct alignment each hand with respect to the other and with respect to the club) is correct. There is accordingly a continuing need for a golf training system which provides for consistent correct placement of each aspect of a golfer's grip.

SUMMARY OF THE INVENTION

The present invention is directed to a golf training system for consistent correct placement of a golfer's hands on a golf club and in relation to each other. The invention includes a golf glove for the hand to be positioned nearest the butt of the club, i.e. the left hand for a right handed golfer (hereinafter referred to as the "upper hand glove"). This glove is typically composed of a standard type golf glove with a series of indicia for correct placement of the user's hands on the golf club. There is a first indicia on the upper hand glove for positioning the hand of the golfer with respect to the lower hand. A second indicia is employed for aligning the thumb with respect to the club. A third indicia is employed for aligning the club across the upper hand. There may also be another indicia to aid in correct positioning of the user's fingers in the golf grip.

The present invention also optionally includes an lower hand glove. As with the upper hand glove, the lower hand glove includes indicia to aid in aligning the hands when gripping a club. For example, the lower hand glove may include indicia to properly align the thumb of the lower hand along the club shaft and/or indicia to properly align the club across the palm of the lower hand.

BRIEF DESCRIPTION OF THE DRAWINGS

The present invention will be described with references to the accompanying drawings, wherein like reference numerals identify corresponding or like components. In the drawings.

DETAILED DESCRIPTION OF THE DRAWINGS

Figure 1:
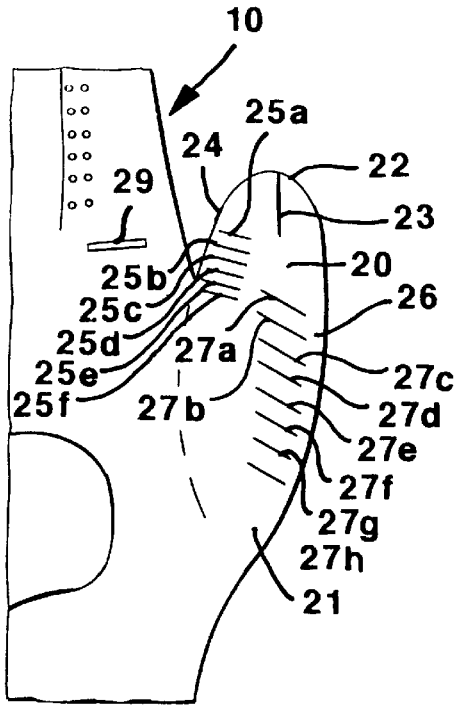
FIG. 1 is a partial view of the back of an upper hand glove of one embodiment of the present invention.
Figure 2:
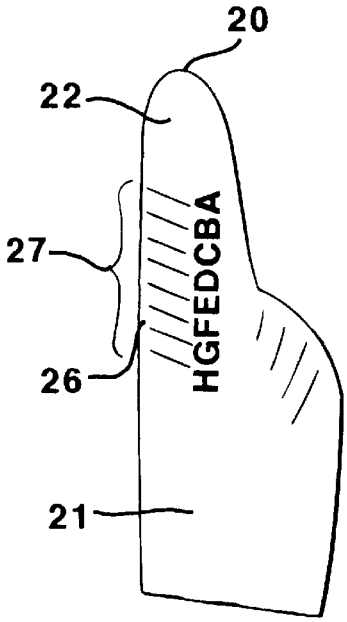
FIG. 2 is a partial side view of the thumb of the upper hand thumb shown in FIG. 1.
Figure 3:
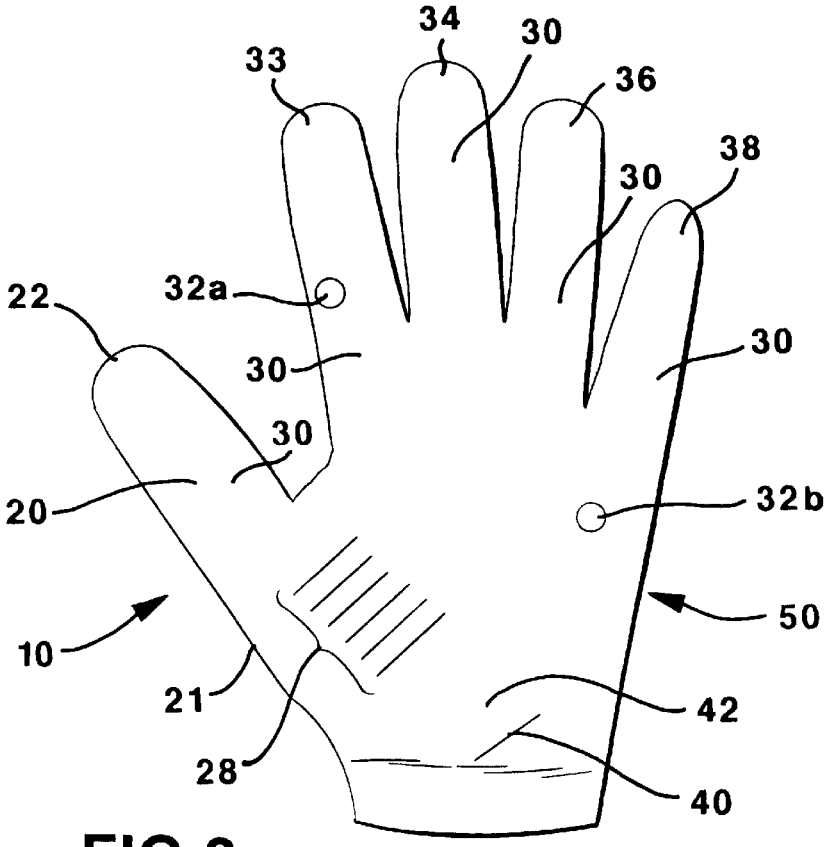
FIG. 3 is a view of the upper hand glove of FIG. 1 showing the palm portion.
Figure 4:
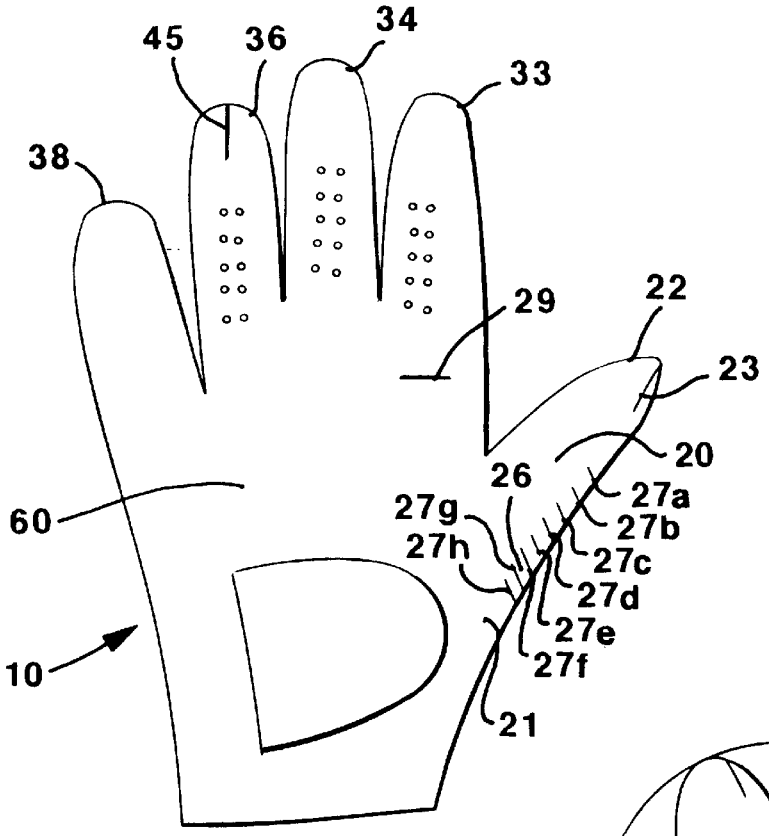
FIG. 4 is a view of the back side of the upper hand glove shown in FIG. 3.
Figure 5:
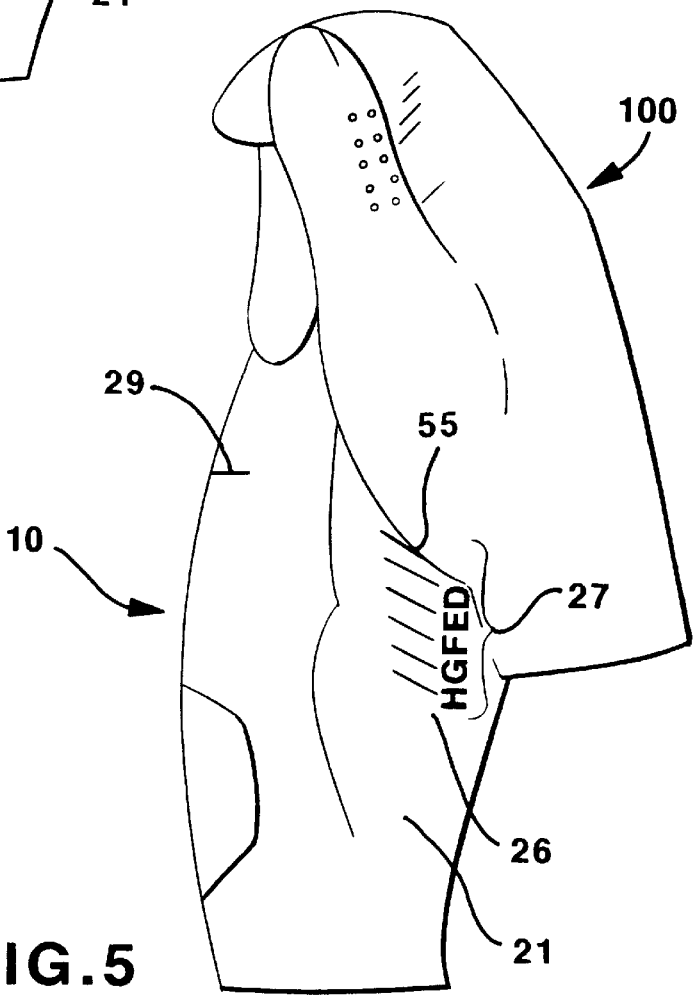
FIG. 5 is a view showing the positioning of upper and lower hands as they would be positioned when gripping a golf club using the upper and lower hand gloves of the invention.
Figure 6:
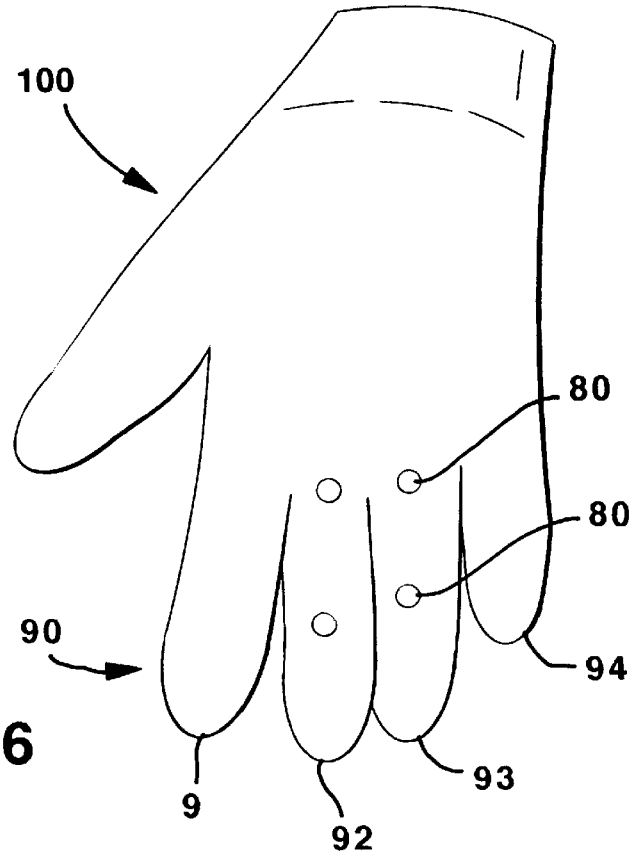
FIG. 6 is a view of the palm of one embodiment of a lower hand glove of the present invention.

Referring now to FIGS. 1–4., one embodiment of an upper hand glove is illustrated. The upper hand glove functions to aid its user in adopting and maintaining a proper grip on a golf club. In the following description, the term "upper hand" is used. As noted above, this terms refers to the hand of the user positioned toward the butt end of the golf club, i.e., the left hand for a right handed golfer. The term "lower hand" refers to the hand positioned lower on the club toward the club head. The glove is generally composed of a standard athletic glove having a palm portion 50, including the inner portion of the hand, and a back portion 60, including the back of the hand, connected by seams, and sections thereof corresponding to the parts of a human hand, such as a thumb, fingers, joints and the like. As shown in FIGS. 1–2, positioning indicia are located on the back portion of the glove sections corresponding to the thumb 20 and index finger 33. FIG. 3 illustrates positioning indicia on the palm 50 of the glove 10. FIG. 4. illustrates positioning indicia on the back 60 of the glove 10. FIG. 5 illustrates the proper positioning of the lower hand with respect to the upper hand using the glove 10 of FIG. 1. FIG. 6 illustrates the optional lower hand glove and an embodiment of positioning indicia thereon.

Regarding the positioning indicia, a first indicia, herein designated hand positioning markings 27, is located on the thumb in the region where the palm portion 50 and the back portion 60 of the glove intersect (FIGS. 1–2). These markings are diagonal equally spaces lines sloping downward toward the palm 50 of the glove 10. In use, the user aligns the outer edge 55 of their lower hand (with or without a lower hand glove) along one of the hand positioning markings 27*a–h* to ensure that both hands are correctly positioned with respect to each other.

The upper hand glove may include one or more of two thumb marking systems to assist in proper alignment of the thumb on the golf club (FIG. 1). First, a thumb alignment marking 23 is located at the back tip of the thumb 20 of the glove 10. This thumb marking 23 extends down the thumbnail area along the longitudinal axis of the thumb. In use, this first thumb alignment marking is positioned such that it aligns with the centerline of the golf club. Other thumb markings may alternatively be used to perform the same function. For example, the first thumb alignment marking may include a straight or broken line which extends longitudinally along a substantial portion of the back of the thumb and may or may not extend as far as the tip of the thumb.

The second thumb alignment marking system includes a mark 29 at the base of the index finger and a series of corresponding markings 25 along the inner region 24 of the thumbnail area. The basal index finger marking 29 is a line generally perpendicular to the longitudinal axis of the index finger and is located on the back side 60 of the glove 10. The inner thumb markings 25 are located on the back side of the glove 60 and consist of equally spaced lines generally perpendicular to the longitudinal axis of the thumb. In use, when the thumb has been positioned down the club centerline, the basal index finger marking 29 aligns with one of the inner thumb markings 25 to ensure proper placement.

The third indicia includes club placement markings located on the palm 50 of the glove (see FIG. 3). These club placement markings may include dots 32*a*, 32*b* located at the knuckle region of the index finger 33 and below the basal region of the last or pinkie finger 38. In use, the golf club handle is aligned with these club placement markings to correctly grasp the club handle and align the club across the palm of the upper hand. Alternatively, the third indicia may include a solid or dotted line connecting the two positions marked by dots 32*a*, 32*b*.

The upper hand glove may also include finger alignment indicia ("fourth indicia") to aid in positioning the fingers in the user's grip. The fourth indicia includes grip markings 28 located on the palm 50 of the glove 10 and the back tip of the third finger 36 (FIGS. 3–4). The grip markings 28 located on the palm 50 are generally situated in the region between the base of the thumb 21 and the heel or bottom of the palm 42. These grip markings may include a series of equally spaced lines 28 generally perpendicular to the longitudinal axis of the thumb when the hand is extended in the fully opened position. The finger alignment indicia also include a third finger grip marking such as a line 45 extending from the tip of the finger along the nail region of the finger. This marking 45 extends along the longitudinal axis of the finger and may be aligned with one of the palm grip marking lines 28 to ensure correct placement of the fingers in the golfer's grip.

The upper hand glove may also include a club butt placement indicia to aid in positioning the upper hand a predetermined distance from the club butt. For example, a club butt placement marking 40 may be located at the heel 42 of the palm 50. The club butt placement marking 40 is generally perpendicular to a line connecting dots 32*a*, 32*b* and is typically located near the center of the heel 42. In use, the golf club butt is positioned so as to extend a predetermined distance beyond the club butt placement mark 40.

Referring now to FIGS. 1–2, the thumb portion 20 of the glove 10 has a base 21, a tip 22, an inner portion 24 and an outer portion 26. Located along the outer portion 26 of the thumb 20 is a hand positioning indicia for proper positioning of the user's hands on a golf club relative to each other. In the embodiment shown in FIGS. 1–2, the hand positioning indicia is a series of diagonal parallel lines 27 beginning on the back 60 in a position facing upwardly toward the tip 22 and extending downwardly between the back 60 and the palm 50 terminating at the palm 50. These parallel line markings 27*a–h* are identified by a system to indicate to the user the proper location of the lower hand. (The base of the thumb of the lower hand is typically lined up with one of the markings as further described below.) As shown in FIG. 2, the upper hand glove normally includes a system of identifying the parallel lines 27 which may consist of letters or numbers assigned to each of the markings 27*a–h*.

It will be understood by those skilled in the art that a variety of identification and marking systems as used herein can be employed within the scope of the present invention to achieve the same purpose. For example, with respect to any of the markings described herein, a series of dots, diamonds or other shapes drawn or sewn on the glove 10 can perform the same function. Perforations forming lines or other markings in the designated positions can likewise perform the same function. Similarly, with respect to identification, a numbering or color coding system may be employed to perform the same function as the lettering of the preferred embodiment and are within the scope of the present invention.

The thumb 20 of the glove 10 also has one or more indicia for positioning the thumb 20 relative to the shaft of a golf club. The embodiment of the second indicia shown in FIG. 1 includes two such indicia, i.e., sets of markings 23 and 25. The first is a marking 23 extending longitudinally from the tip 22 of the thumb 20 partially down the back 60 thereof bisecting the tip 22 into two even halves. This longitudinal thumb marking 23 functions to aid the wearer of the glove 10 in aligning the thumb with respect to the centerline of the golf club. Although an illustrative embodiment of the longitudinal thumb alignment mark is shown in FIG. 1, one skilled in the art will recognize that other markings, e.g., a straight or broken line extending longitudinally along a substantial portion of the back of the thumb, may also be used to perform the same function. The second thumb positioning indicia shown in FIG. 1 includes a series of transverse parallel markings 25*a–f* located along the inner portion 24 of the thumb 20. These inner thumb markings 25*a–f* are located on the back 60 of the glove 10 and correspond with a transverse mark 29 located at the base of index finger 33 also on the back 60 of the glove 10. When the user has correctly aligned their thumb along the club shaft, one of the markings 25*a–f* aligns with the basal index finger mark 29. The present upper glove preferably includes at least longitudinal thumb tip marking 23 and, more preferably, includes both (i) thumb tip marking 23 and (ii) the set of traverse thumb marking 27 and parallel markings 25*a–f*.

Referring now to FIG. 3, the palm portion 50 of the upper hand glove 10 of the present invention is shown. Designated generally by numeral 30 are the finger portions of the glove 10. A club placement indicia is located along the palm 50 for proper positioning of a golf club in the upper hand of the user. This indicia includes a club placement marking located in a position corresponding to the rear of the user's index finger knuckle. In the embodiment shown in FIG. 3, this marking is a dot 32*a*. As indicated above, it will be understood by those skilled in the art that a variety of markings can be employed within the scope of the present invention to achieve the same purpose. For example, other shapes sewn or drawn on the palm 50 or perforations in the corresponding location can be used to achieve the same purpose.

A corresponding club placement marking (dot 32*b* in FIG. 3) is located below the base of the pinkie or little finger 38 of the glove 10. This marking is situated along the palm 50 in a position along the longitudinal axis of the little finger 38. These club placement markings form a line between the two points indicating to the user the proper position of the club shaft. An alternative embodiment of the club placement markings include a stripe or line in the area of the line formed by connecting dots 32*a* and 32*b*.

The upper hand glove also includes finger placement indicia located along the palm 50 and back tip of the third finger 36. For example, a grip marking located at the back 60 tip of the third finger 36 (FIG. 4) and a series of palm grip markings beginning a small distance below the base of the thumb 20 on the palm 50 and extending downward toward the heel 42 of the palm 50 may be employed (FIG. 3). The series of palm grip markings in the embodiment shown in FIG. 3 are parallel lines 28 generally perpendicular to the longitudinal axis of the thumb 20 when in "open hand" position as shown in FIG. 3.

Located at the heel 42 or bottom portion of the palm 50 of the glove may be a club placement mark 40 for ensuring that the upper hand is positioned correctly along the shaft handle of the club (FIG. 3). This club placement mark 40 begins at the glove portion corresponding to the heel of the hand, extends upwardly toward the little finger 38 and away from the thumb 23, and is generally parallel with lines 28. This mark 40 allows the user to consistently place their upper hand in the correct location along the shaft handle of a golf club.

FIG. 5 shows a view of both upper and lower hands postitioned as they would be in gripping a golf club and utilizing the upper and lower hand gloves of the present invention. When the club is gripped properly, the edge 55 of the back basal portion of the lower hand thumb is aligned with one of the hand positioning markings 27*a–h* on the upper hand glove. Depending on the type of grip desired, the positioning of the lower hand may be adjusted so that the lower hand thumb edge 55 is aligned with a different one of hand positioning marking 27*a–h*. For example, if a hand position which will fade a golf ball is desired, lower hand thumb edge 55 may be aligned with marking 27*b*. On the other hand, if a hand position which would draw the ball is desired, the lower hand thumb edge 55 will typically be aligned with hand positioning marking 27*f* or 27*g*.

Figure 7:
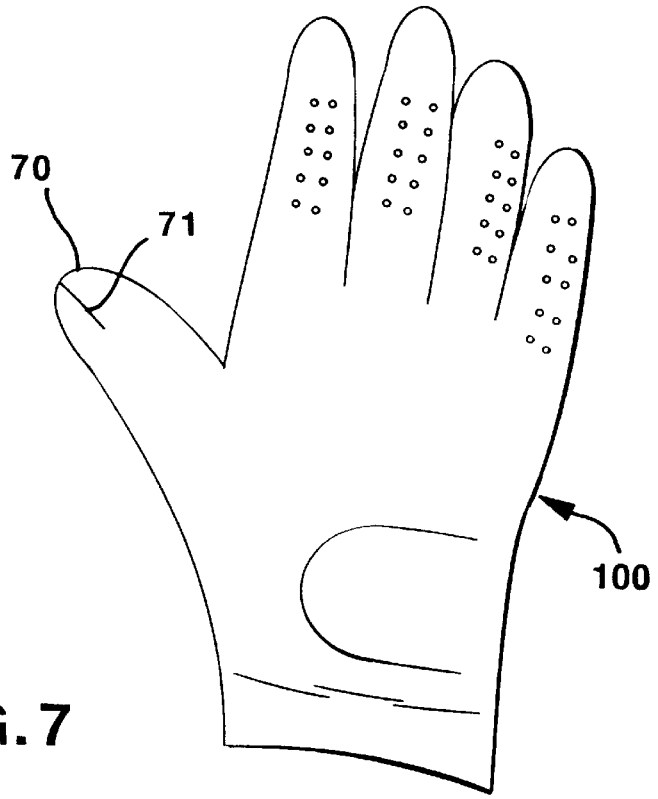
FIG. 7 is a view of the back side of the lower hand glove shown in FIG. 6.

Referring now to FIG. 6 and 7, an embodiment of the optional lower hand glove 100 is shown. The lower hand glove may include a thumb alignment marking 71 on the back tip portion of the thumb 70 and/or club placement markings 80. The thumb alignment mark 71 is located on the lower hand glove in a position analogous to the thumb alignment marking 23 on the upper hand glove 10. The club placement markings 80 shown in FIG. 6 typically include dots located on the palm side at the base and first joint regions of the second 92 and third 93 fingers of the lower hand and aid in positioning the club across the palm of the lower hand.

Use of the Training System

To use the golf training system to develop and maintain a proper grip on a golf club, the upper hand glove 10 of the present invention is placed on the hand of the user to be positioned nearest the butt end of the club handle (i.e. on the left hand of a right handed golfer). The user then typically places the golf club in their upper hand with the glove palm 50 facing upwardly so that the user can see the indicia thereon. The handle should rest diagonally between the thumb 20 and index finger 33 and the heel 42 of the glove; the butt of the club extending past the heel 42 a small distance. The butt of the golf club is then positioned such that the club butt mark 40 at the heel 42 of the palm 50 is a predetermined distance within the butt of the club (see FIG. 3). This predetermined distance is generally between ½ inch and 1 inch. It will be understood by those skilled in the art that this distance will vary based upon the exact positioning of marking 40 along the palm 50.

The fingers 30 are then wrapped around the club handle such that the club placement markings (dots 32*a*, 32*b*) are positioned along the line formed by the club handle edge nearest the fingers 30. The user may then look at the grip markings to ensure that grip marking 45 on the back of the third finger 36 aligns with one of the palm grip markings 28 to ensure proper positioning of fingers 30. The thumb 20 is then positioned along the top of the club shaft handle so that thumb marking 23 aligns with the centerline of the club shaft. To ensure that this positioning of the thumb is correct, the user may also look to see that the basal index finger mark 29 aligns with one of the inner thumb markings 25*a–f*. Alignment of index finger marking 45 with one of the inner thumb marking lines 25*a–f* indicates correct positioning of the thumb 20.

The lower hand may be then placed on the golf club handle in similar manner as described above without the guidance of a glove with indicia to ensure proper placement. The lower hand is placed on the club such that the thumb region of the lower hand overlaps or rests atop the back 60 of the thumb 20 of the upper hand. A line then becomes visible to the user where the edge of the outer surface of the lower hand thumb intersects the plane of the back of the upper hand thumb. This line is then aligned with one of the hand positioning markings 27*a–h* based upon the kind of shot desired by the user, herein to aid in aligning the lower hand with respect to the golf club.

Thus, the invention has been described with reference to various specific and preferred embodiments and techniques. However, it should be understood that many variations and modifications may be made while remaining within the spirit and scope of the invention, and the invention is not intended to be construed as limited to the specific embodiments in the drawings. For example, the optional second glove to be worn on the lower hand may be provided having one or more the indicia as described to aid in positioning the lower hand with respect to the golf club shaft.

What is claimed is:

1. A golf training system for aligning upper and lower hands on a golf club comprising an upper hand golf glove having a palm, and a thumb, said glove including:

(a) hand positioning indicia for positioning the lower hand with respect to the upper hand, said hand positioning indicia comprising markings with an identification system located on an outer portion of the thumb;

(b) a first thumb alignment indicia on the back of the thumb for aligning the thumb with respect to the club; and (c) club placement indicia across the palm for aligning the club across the palm of the upper hand.

2. The system of claim 1 wherein the hand positioning indicia comprises a plurality of regularly spaced markings.

3. The system of claim 2 wherein the markings comprise dots, diamonds, or parallel lines.

4. The system of claim 2 wherein the markings comprise perforations in said glove.

5. The system of claim 1 wherein the first thumb alignment indicia comprises a line along a portion of the length of the back of said thumb.

6. The system of claim 5 wherein the first thumb alignment indicia comprises a marking on a tip of the back of the thumb.

7. The system of claim 1 wherein the first thumb alignment indicia comprises a plurality of regularly spaced markings.

8. The system of claim 1 further comprising a second thumb alignment indicia including a line on a back basal portion of an index finger of said upper hand glove and transverse markings on an inner back portion of the thumb.

9. The system of claim 1 wherein the upper hand golf glove further comprises fingers and a grip indicia including a grip marking on a back of one of the fingers and finger alignment markings between the base of the thumb and a heel of the palm for positioning the fingers of the upper hand.

10. The system of claim 1 further comprising a club butt placement indicia on a heel of the upper hand glove palm.

11. The system of claim 1 further comprising a lower hand golf glove which includes club placement indicia on a palm section for aligning the club across the lower hand palm.

12. The system of claim 11 wherein the lower hand golf glove further comprises a third thumb alignment indicia.

13. A golf training system for aligning upper and lower hands on a golf club comprising upper and lower hand golf gloves each having a thumb and a palm, wherein the upper hand golf glove includes:

(a) hand positioning indicia for positioning the lower hand with respect to the upper hand, said hand positioning indicia including a plurality of regularly spaced markings with an identification system on an outer portion of the thumb;

(b) first thumb alignment indicia on the back of the thumb for aligning the thumb with respect to the club;

(c) first club placement indicia on the palm for aligning the club across the upper hand palm; and the lower hand golf glove includes a second club placement indicia on the palm for aligning the club across the lower hand palm, and a second thumb alignment indicia for aligning the lower hand thumb with respect to the club.

14. The system of claim 13 wherein the hand positioning indicia comprises a plurality of regularly spaced markings.

15. The system of claim 13 wherein the first thumb alignment indicia comprises a line along a portion of the length of the back of said thumb.

16. The system of claim 13 further comprising a second thumb alignment indicia including a line on a back basal portion of an index finger of said upper hand glove and transverse markings on an inner back portion of the thumb.

17. The system of claim 13 wherein the upper hand golf glove further comprises fingers and a grip indicia including a grip marking on a back of one of the fingers and finger alignment markings between the base of the thumb and a heel of the palm for positioning the fingers of the upper hand.

18. A method of training a golfer to apply a proper grip on the shaft of a golf club, comprising:

(a) placing a golf glove on an upper hand, said golf glove including a plurality of hand positioning markings with an identification system on an outer portion of the thumb, a thumb alignment marking along a back portion of the thumb, club placement markings across a palm of the golf glove, and a club butt marking on a heel of the palm;

(b) aligning a butt of the club with said club butt marking;

(c) aligning the club shaft along the line formed on the palm by said club placement markings;

(d) wrapping upper hand fingers around the club shaft such that said thumb alignment marking is aligned along the club shaft; and (e) gripping the club shaft with the lower hand such that an edge of a outer surface of the lower hand thumb aligns with one of said hand positioning markings on said upper hand glove.

* * * * *